US006264149B1

(12) United States Patent
Bohman

(10) Patent No.: US 6,264,149 B1
(45) Date of Patent: Jul. 24, 2001

(54) KEYBOARD HOLDER

(75) Inventor: Göte Bohman, Hudiksvall (SE)

(73) Assignee: Bohman Information I Hudiksvall AB, Hudiksvall (SE)

( * ) Notice: Subject to any disclaimer, the term of this patent is extended or adjusted under 35 U.S.C. 154(b) by 0 days.

(21) Appl. No.: 09/308,714

(22) PCT Filed: Nov. 26, 1997

(86) PCT No.: PCT/SE97/01980

§ 371 Date: May 24, 1999

§ 102(e) Date: May 24, 1999

(87) PCT Pub. No.: WO98/23185

PCT Pub. Date: Jun. 4, 1998

(30) Foreign Application Priority Data

Nov. 26, 1996 (SE) ..... 9604340

(51) Int. Cl.[7] ..... B68G 5/00

(52) U.S. Cl. ..... 248/118; 248/118.3; 248/454; 248/456

(58) Field of Search ..... 248/118, 118.1, 248/118.3, 118.5, 918, 920, 921–924, 284.1, 291.1, 371, 447, 462, 441.1, 454–457; 400/472, 715

(56) References Cited

U.S. PATENT DOCUMENTS

| | | | | |
|---|---|---|---|---|
| 4,467,727 | * | 8/1984 | Strommer | 248/456 X |
| 4,618,119 | * | 10/1986 | Strommer | 248/456 X |
| 5,040,757 | | 8/1991 | Benaway | 248/118.3 |
| 5,112,020 | * | 5/1992 | Ginsberg | 248/456 |
| 5,242,139 | | 9/1993 | Aldrich | 248/118 |
| 5,351,897 | | 10/1994 | Martin | 248/118 |
| 5,375,800 | * | 12/1994 | Wilcox et al. | 248/118.1 |
| 5,379,973 | * | 1/1995 | Rader | 248/118.1 |
| 5,433,407 | * | 7/1995 | Rice | 248/118.1 |
| 5,484,124 | * | 1/1996 | Billings | 248/118 |
| 5,533,820 | * | 7/1996 | Ambrose | 400/472 |
| 5,818,360 | * | 10/1998 | Chu et al. | 248/118.3 X |
| 5,833,178 | * | 11/1998 | Plasse et al. | 248/27.8 |
| 5,915,655 | * | 6/1999 | Gutowski | 248/118.5 |
| 5,927,662 | * | 7/1999 | West et al. | 248/118 |

FOREIGN PATENT DOCUMENTS 9533394 12/1995 (WO) .

* cited by examiner

*Primary Examiner*—Leslie A. Braun
*Assistant Examiner*—Tan Le
(74) *Attorney, Agent, or Firm*—Young & Thompson

(57) ABSTRACT

The present invention relates to a holder for keyboards of the type used in computer work, said holder having the form of a separate attachment comprising a carrier (8) which serves to support the keyboard and which is hingedly connected to a supporting part which is adapted to abut and rest against a base. The carrier (8) is turnable to permit adjustment of the keyboard at an angle relative to a horizontal plane, more specifically between on the one hand a first horizontal position and, on the other hand, a second raised position where an upper side of the keyboard is directed away from the user at an angle of at least 30° relative to the horizontal plane. The carrier (8) is hingedly connected to the supporting part adjacent to a rear longitudinal side edge and is, with a front longitudinal side edge raisable and, by means of a locking device, lockable in the raised position at an angle to the supporting part.

8 Claims, 3 Drawing Sheets

KEYBOARD HOLDER

Figure 1:
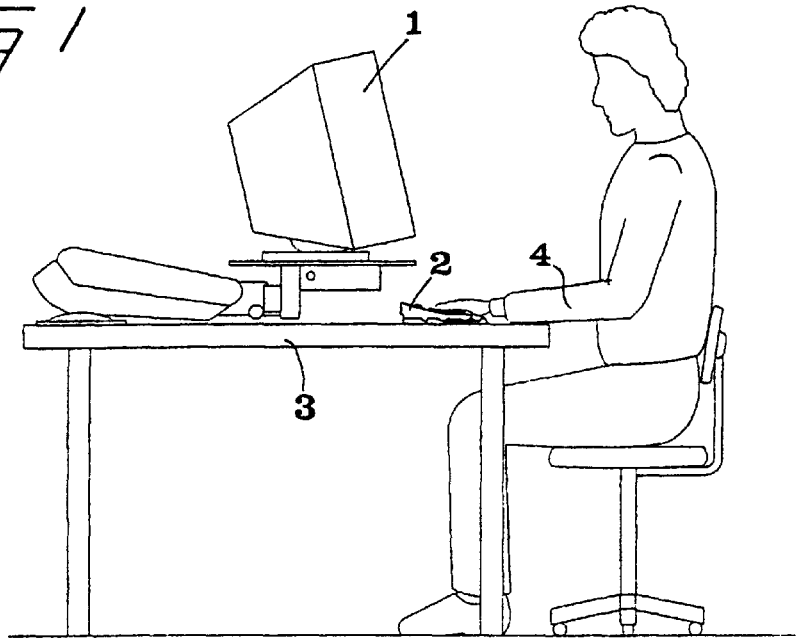

The present invention relates to a holder for keyboards of the type used in computer work, said holder having the form of a separate attachment which is placeable on a base and comprises a carrier, which serves to support the keyboard and which is hingedly connected to a supporting part, which is adapted to abut and rest against the base, the carrier being turnable relative to the supporting part about a horizontal axis to permit adjustment of the keyboard at an angle relative to a horizontal plane, and more specifically the carrier is adjustable between on the one hand a first, horizontal position where the keyboard is located horizontally or essentially horizontally to enable a user to work in a sitting position and, on the other hand, a second, raised position where an upper side of the keyboard is directed away from the user at an angle of at least 30° relative to the horizontal plane, thereby enabling the user to work in a standing position with arms and hands directed downwards.

BACKGROUND ART

Many people sitting by a computer for long working periods suffer from tension and pain in neck and shoulders resulting in chronic strain injuries. Today's word processors do not give the same opportunities of so-called microbreaks as did the typewriters, for instance in the form of shifting sheets of paper or manually correcting the text. Long working periods with precision work using a mouse have also been found to cause strain in neck and shoulders and pain in the arm by which the mouse is operated, a so-called mouse arm.

Various keyboard holders are known, which are arranged to permit adjustment of the keyboard at an angle relative to the horizontal plane. For instance, U.S. Pat No. 5,351,897 discloses a keyboard holder which is adapted to be fixed to a desk top in a recessed position relative thereto and which has a flat panel and a mounting with a movable and a fixed part. The movable part, on which the flat panel is mounted, is pivotable about a horizontal axis which permits adjustment of the panel at a negative angle such that the keyboard upper side with the keys is facing away from or inclined downwards away from the user. The idea is that the keyboard, thanks to the recessed positioning of the holder relative to the desk top, should be located as close to the user's legs or knees as possible, and a slight negative angling of the keyboard results in a neutral position of the hands without any angling of the wrist. A drawback of this keyboard holder is that the operator is obliged to work sitting in a relatively static working position with a great, essentially right angle between the upper parts of the arms and the forearms and with the forearms extended essentially horizontally without any real possibility of changing the position.

Other keyboard holders, such as those according to U.S. Pat. Nos. 5,242,139 and 5,040,757, have a support for wrist and palm and are arranged to provide a slight angling of the keyboard from the user, but also these keyboard holders do not offer any possibility of changing the working position and relieving arms, shoulders and back.

The company Jargus at Karlsborg, Sweden, has for some time been selling a holder for keyboards in the form of an attachment, the carrier for the keyboard being raisable to a position where an upper side of the keyboard is directed away from the user at an angle of at least 30° relative to the horizontal plane. However, the keyboard carrier of the Jargus holder is hingedly connected to the supporting part via a hinge which is turnable about a horizontal axis located essentially in the centre of the keyboard carrier. This means that the keyboard carrier must be located at a relatively great distance from the base to be able to make such a great angle as 30° or more in its raised state. This is disadvantageous since it means that the holder will have a great thickness or height also in its lowered, horizontal position, which renders a comfortable working position when sitting down difficult or even impossible. If the holder is in fact placed on a level allowing a comfortable working position for the user's forearms, this will imply that the supporting part of the holder is placed on such a low level that this, and especially the base on which it stands, is on a level with the user's knees and thighs, and consequently he cannot place himself sufficiently close to the holder and the keyboard. To be able to reach the keys furthest away on the keyboard, the user must thus stretch himself forwards or alternatively raise the base and the keyboard holder, which will result in a considerably deteriorated working position for arms and shoulders.

DESCRIPTION OF THE INVENTION

The present invention aims at obviating the above-mentioned problems and drawbacks of prior art and providing a keyboard holder which makes it possible for the operator to change working position quickly and easily, and making it possible for the operator to place himself in a working position that relieves back, neck, shoulders and arms. In particular, the invention aims at a keyboard holder whose thickness or height in its lowered state is minimal, but which allows raising of the keyboard carrier to an angle of at least 30° without the rear portion of the carrier abutting against the base, and which thus enables a comfortable working position for the user when sitting down since he may easily insert his knees and legs under the holder and the base and all the same work with essentially horizontally extended forearms. At least these objects are achieved by a keyboard holder as set forth herein.

The invention thus is based on the knowledge that shifting between a sitting and a standing position while at the same time the position of the arms is changed from essentially horizontally extended forearms to downwardly directed forearms, prevents the strain which may result in a work injury. A holder according to the invention achieves this by the keyboard carrier being settable at an angle between a horizontal position, for a sitting working position, and a raised position where the keyboard is angled such that its upper side is directed away from the operator, for a standing working position.

According to the invention, the holder is designed as an attachment for an existing desk and is placed on the desk top or some other part of the desk, e.g. an extendible panel intended for the keyboard.

The holder can advantageously be equipped with a second carrier, which is also settable at an angle and intended to support a trackball, control plate or some other cursor control device supplementing or replacing a conventional mouse. The trackball or control plate does not require any movements of the arm as does the mouse, but small movements of the fingers are enough to operate a cursor on the display. This second carrier, which is not at all to be found on the Jargus holder, is suitably set at a different angle compared with the first carrier, thereby permitting as comfortable a working position as possible for the operator. In an alternative embodiment, the carrier could be separately adjustable independently of the angle of the first carrier.

In a preferred embodiment, the carriers are plates made of some suitable material, preferably wood, plastic or aluminium. Instead of plates, it should however be possible to design the carriers as frames or the like. Preferably the holder should be combined with a vertically adjustable arm carrying the display so as to make it possible to raise the display when working in a standing position. It has been found that the carrier should be adjustable at an angle of at least 30° relative to the horizontal plane to achieve a comfortable working position for the arms when working in a standing position. For tall people, greater angles are as a rule necessary, preferably 40° and most preferred 50° or more. This results in a comfortable and natural position of the arms in a standing working position with a keyboard holder in the form of an attachment placed on, for instance, a desk top or some other type of keyboard holder at a corresponding level. In the preferred embodiment shown in the drawings, the holder can be adjusted at a maximum angle of about 60°. However, the invention is not limited to this, but also greater angles are possible.

In the described, preferred embodiment of the invention, the keyboard holder is provided with a supporting strip along its front edge. This makes it possible for the user when standing to shift between loosely hanging arms and a supporting position in which the hands rest against the supporting strip and relieve arms and shoulders. Also when sitting, the user's hands may rest against the supporting strip.

The invention is not limited to be applied merely to keyboards of flat shape, but may also with a suitable design be used for keyboard types which are angled and which together with the desk top form an equilateral triangle seen from the operator's side, i.e. an inverted V, where the keys are arranged on the two inclined upper surfaces.

In the preferred embodiment, the locking device for locking the carrier at an angle to the horizontal plane has the form of a yoke which may engage in one of a plurality of recesses in a supporting part abutting against the base. This locking device could, however, be designed in many different ways, for instance by regulatable screw joints between supporting part and carrier, which would result in infinitely variable adjustment of the carrier.

FURTHER ELUCIDATION OF PRIOR ART

Vertically adjustable desks are already available on the market, which allow work to be carried out standing, the desk top being in a raised position, but the operator still has the same working position for the arms as in a sitting working position, i.e. the upper parts of the arms and the forearms being positioned at a great angle relative to each other and the forearms being extended essentially horizontally forwards. Such desks certainly make it possible to shift the working position between a sitting and a standing position but otherwise cause the same problems with strain injuries as described above since the upper part of the body still has the same working position as when working in a sitting position. Vertically adjustable desks are also comparatively expensive to buy and, owing to their size, difficult to fit into an existing working place.

BRIEF DESCRIPTION OF THE ACCOMPANYING DRAWINGS

In the drawings

Figure 2:
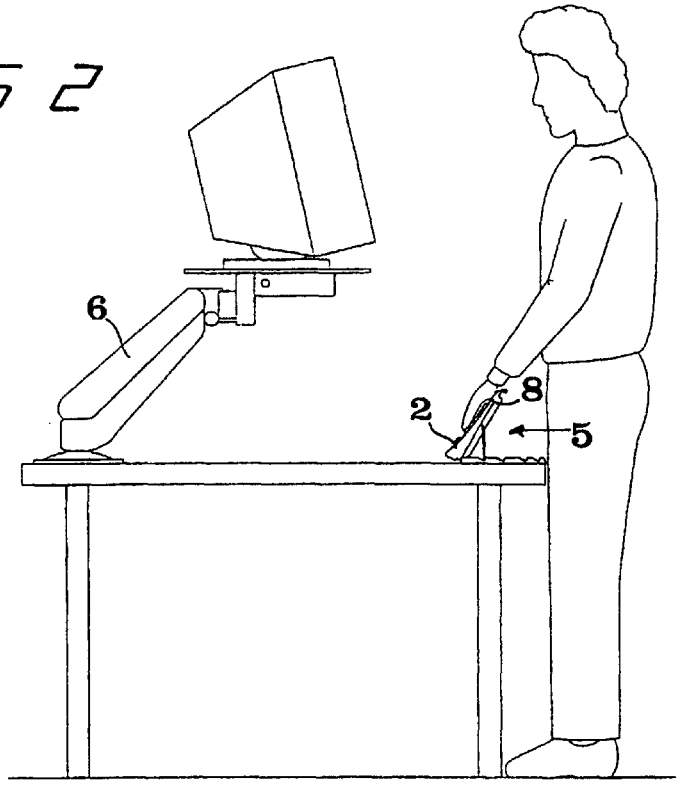
Figure 3:
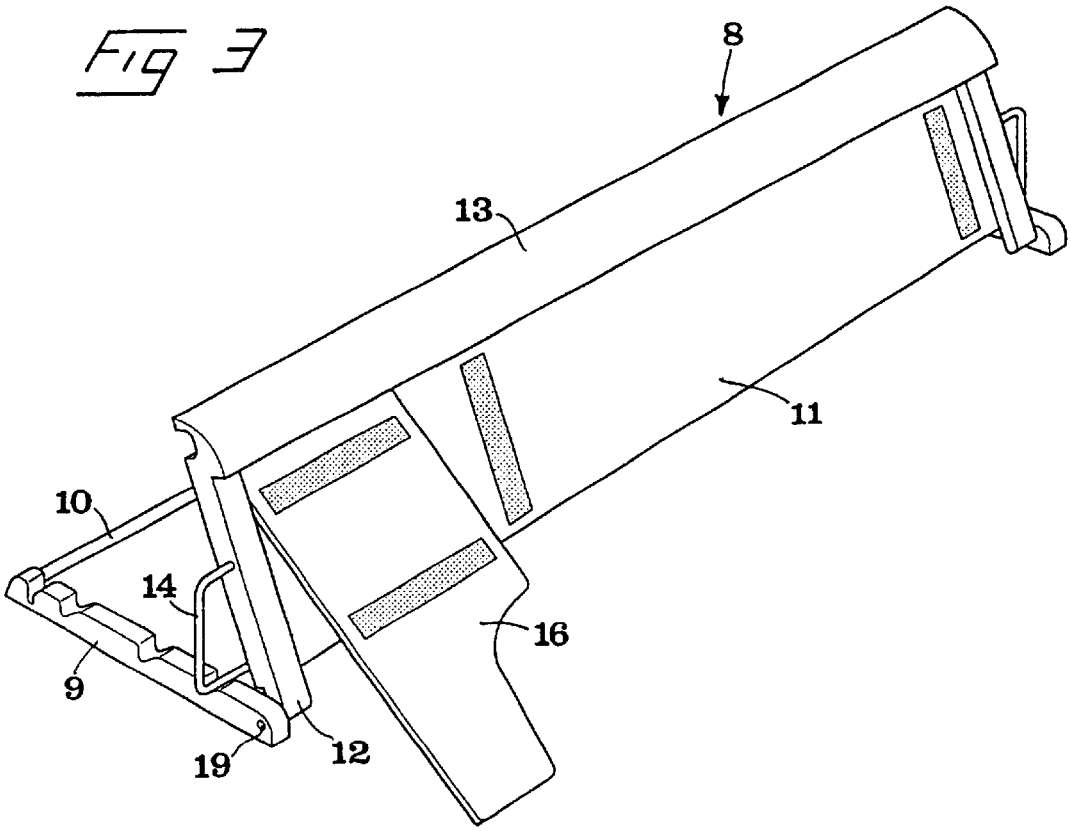
Figure 4:
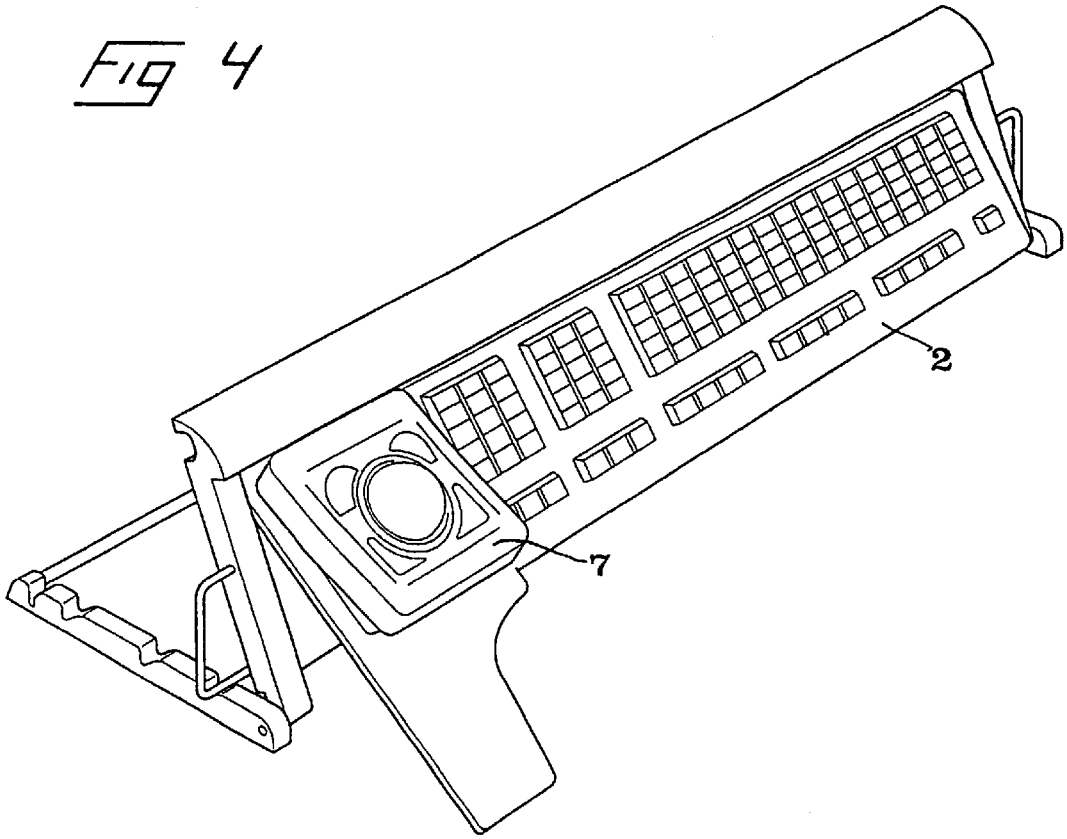
Figure 5:
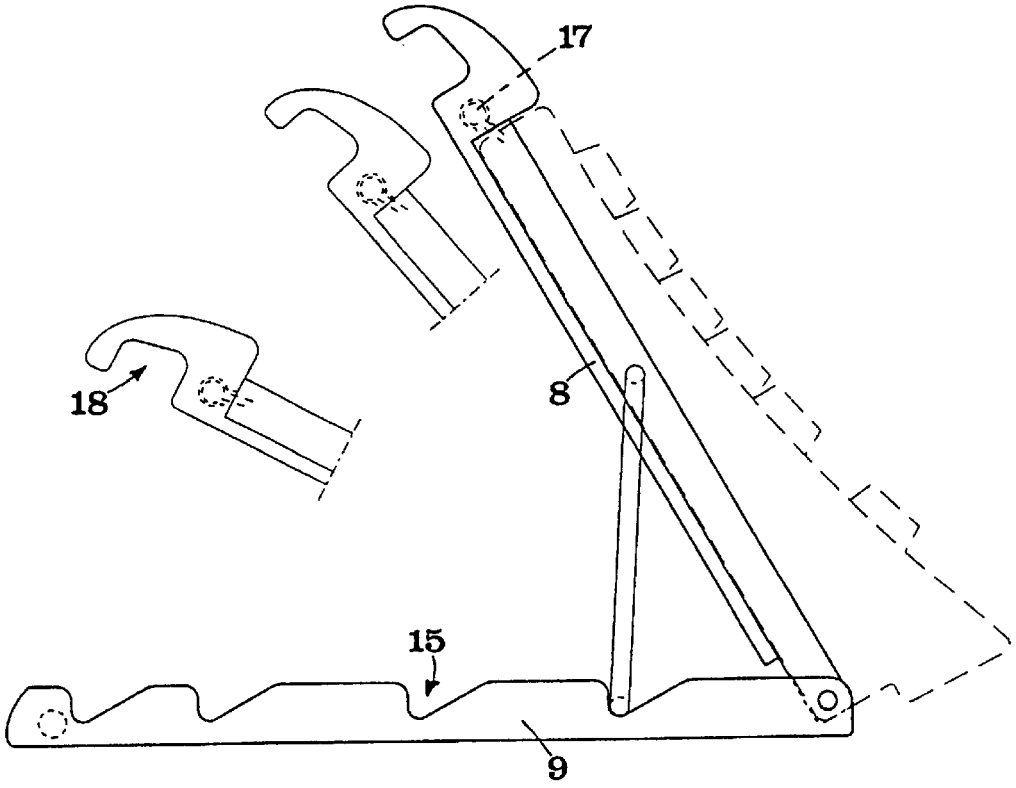
Figure 6:
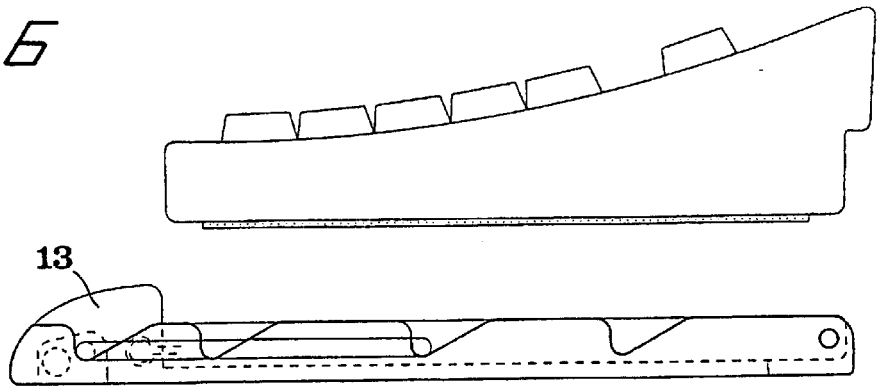

FIG. 1 is a schematic side view which illustrates a person engaged in keyboard work in a sitting position, FIG. 2 is a side view according to FIG. 1, but here the person is carrying out the work in a standing position with the keyboard angled upwards in accordance with the invention, FIG. 3 is a perspective view of a preferred embodiment of a keyboard holder according to the invention, FIG. 4 shows a keyboard holder according to FIG. 3, on which a keyboard and a trackball are mounted, FIG. 5 is side view of a keyboard holder, which illustrates the carrier in different angular setting positions, and FIG. 6 is a side view according to FIG. 5, the carrier being in the lowered, essentially horizontal position.

DETAILED DESCRIPTION OF A PREFERRED EMBODIMENT OF THE INVENTION

Now follows a description of a preferred embodiment of a keyboard holder according to the invention, which is designed as a separate attachment which can be placed on, for instance, a conventional desk. FIG. 1 illustrates a person who in a sitting position is engaged in keyboard work by a computer 1. A keyboard is designated 2 and is in conventional fashion placed horizontally on a desk top 3. In such a working position the user's arms 4 will be considerably angled at an angle of or close to 90° between the upper parts of the arms and the forearms which are essentially horizontally extended forwards.

FIG. 2 shows the same person occupied with keyboard work in a standing position. In this case, the keyboard 2 has been arranged in a raised position by means of an inventive keyboard holder generally designated 5. More specifically, the keyboard is angled such that the keys are directed away from the user, which makes it possible to work in a standing position with the arms directed downwards and no or just a small angle between the upper parts of the arms and the forearms. In addition to the positive effect achieved by now and then switching the working position between sitting and standing, such a working position with "hanging" arms results in a considerable relief of, above all, arms, shoulders, back and neck. To obtain an ergonomically correct standing working position, the display 1 should be vertically adjustable, for instance by means of an articulated bracket 6.

Reference is now made to FIGS. 3 and 4, which show in more detail the design of the preferred keyboard holder in a raised position, FIG. 3 showing the holder without keyboard, while FIG. 4 shows the holder with the keyboard mounted and with a mounted so-called trackball 7 for controlling a cursor on the display. The keyboard holder comprises an elongate carrier 8 and a supporting part made up of two lateral members 9 and a rod 10 interconnecting the same. The carrier 8 and the lateral members 9 are hingedly interconnected via a hinge 19 at the rear longitudinal side edge of the carrier in such a manner that the carrier can be raised, as shown in FIGS. 3 and 4, while the lateral members 9 abut and rest against the base.

The carrier 8 is in turn made up of a panel 11, two stiffening and reinforcing edge elements 12 and a front supporting strip 13. For adjustment of the carrier 8 in different angular positions relative to the base and the lateral members 9, a yoke-shaped locking element or a locking yoke 14 is arranged on the back of the carrier in such a manner that each end of the locking yoke is rotatably fixed in a hole in the respective edge strip 12 while a lower long side portion of the yoke is arranged to rest in one of a plurality of recesses 15 in the lateral members 9.

A second carrier or cursor control carrier is designated 16 and is, as is evident from FIG. 5, hingedly connected to the carrier 8 at its upper end via a thickened portion 17 which is insertable into a groove in the supporting strip 13. The cursor control carrier 16 has a length exceeding the width of the carrier 8 and will consequently rest against the base at its lower edge and, thus, takes a less steep inclination than the panel 11 of the carrier. The purpose of this is to achieve a comfortable position of the hands and to make a cursor control in the form of a trackball 7, as shown in FIG. 4, function satisfactorily and with no risk of the ball falling out. To hold the keyboard 2 and the trackball 7 in the raised position of the carrier, Velcro strips are arranged on their back and on the upper surface of the panel and the cursor control carrier, respectively.

FIG. 5 shows schematically different setting positions of the carrier 8 in relation to the lateral members 9. By arranging the locking yoke in one of the three first recesses 15, seen from the right in FIG. 5, the carrier will take the respective schematically illustrated positions. When the locking yoke is arranged in the recess located furthest to the left in the Figure, the keyboard holder will be completely folded to the position shown in FIG. 6, the carrier being essentially in parallel with and in engagement with the base or at a minimum distance therefrom. In this position the keyboard can be used in conventional manner for work in a sitting position. The forwards rounded supporting strip 13 serves as a support for hands and wrists both in the raised and in the folded position. A recess 18 in the underside of the supporting strip 13 permits complete lowering of the carrier 8 against the base by the long side portion of the locking yoke 14 and the rod 10 being located in the recess in the lowered position.

What is claimed is:

1. A holder for a computer keyboard, the holder comprising:

a supporting part that is adapted to non-fixedly rest on a base;

a first carrier that is adapted to support a computer keyboard, said first carrier having one end hingedly connected to said supporting part about a substantially horizontal axis so that said first carrier is movable between a first position where said first carrier is substantially coplanar with said supporting part and a second position where said first carrier is at an angle of at least 30° from the plane of said supporting part;

an arm support strip on the end of said first carrier opposite to the end of said first carrier hingedly connected to said supporting part, said arm support strip having a support surface that is elevated relative to said first carrier for supporting hands of a user; and a locking device that selectively holds said first carrier at the second position.

2. The holder of claim 1, wherein said supporting part includes plural recesses and said locking device comprises a generally U-shaped yoke having arms rotatably attached to sides of said first carrier and a portion that is receivable by one of said recesses of said supporting part so as to define an angle of said first carrier relative to the plane of said supporting part.

3.The holder of claim 1, further comprising a second carrier having a length greater than the width of said first carrier and makes an angle with the plane of said supporting part less than said first carrier when said first carrier is not in said first position.

4. A holder for a computer keyboard, the holder comprising:

a supporting part that is adapted to non-fixedly rest on a base;

a first carrier that is adapted to support a computer keyboard, said first carrier being hingedly connected to said supporting part about a substantially horizontal axis so that said first carrier is movable between a first position where said first carrier is substantially coplanar with said supporting part and a second position where said first carrier is at an angle of at least 30° from the plane of said supporting part;

a second carrier having a length greater than the width of said first carrier and makes an angle with the plane of said supporting part less than said first carrier when said first carrier is not in said first position; and a locking device that holds said first carrier at the second position.

5. The holder of claim 4, further comprising an arm support strip on one edge of said first carrier, said arm support strip having a support surface that is elevated relative to said first carrier for supporting hands of a user.

6. The holder of claim 4, wherein said supporting part includes plural recesses and said locking device comprises a generally U-shaped yoke having arms rotatably attached to sides of said first carrier and a portion that is receivable by one of said recesses of said supporting part so as to define an angle of said first carrier relative to the plane of said supporting part.

7. The holder of claim 5, wherein said second carrier has an edge that extends beyond an edge of said first carrier opposite said arm support strip.

8. The holder of claim 7, wherein said second carrier is hingedly connected to said first carrier adjacent to said arm support strip of said first carrier.

* * * * *